US005923012A

United States Patent [19]

Bourke et al.

[11] Patent Number: 5,923,012

[45] Date of Patent: Jul. 13, 1999

[54] FLOTATION METHOD AND APPARATUS FOR TREATMENT OF CYCLONE SANDS

[75] Inventors: Peter Bourke, Forrestfield; David Taylor, Gordon, both of Australia; Timo Niitti, Espoo; Jouko Kallioinen, Hollola, both of Finland

[73] Assignee: Outokumpu Mintec Oy, Espoo, Finland

[21] Appl. No.: 08/846,689

[22] Filed: Apr. 30, 1997

[30] Foreign Application Priority Data

May 1, 1996 [AU] Australia ..... PN9611

[51] Int. Cl.[6] ..... B03D 1/16; B03D 1/14; B03B 13/00

[52] U.S. Cl. ..... 209/169; 209/1; 209/168; 209/170

[58] Field of Search ..... 209/168, 169, 209/170, 1

[56] References Cited

U.S. PATENT DOCUMENTS

| | | |
|---|---|---|
| 2,107,289 | 2/1938 | Denny . |
| 2,122,028 | 6/1938 | Daman . |
| 2,441,584 | 5/1948 | McNeill . |
| 5,219,467 | 6/1993 | Nyman . |
| 5,472,094 | 12/1995 | Szymocha . |

FOREIGN PATENT DOCUMENTS

| | | |
|---|---|---|
| 696758 | 10/1964 | Canada . |
| 1226805 | 3/1971 | United Kingdom . |

OTHER PUBLICATIONS

Claridge, P.G. "Operation and Maintenance in Mineral Processing Plants " Special vol. (40) Copyright 1989, The Canadian Institute of Mining & Metallorgy.

*Primary Examiner*—Thomas M. Lithgow
*Attorney, Agent, or Firm*—Smith-Hill and Bedell

[57] ABSTRACT

An apparatus for extracting floatable minerals from a slurry (3). Slurry (3) is fed into a tank (2) via a feed inlet (25) and agitated and aerated so as to create an upper zone containing froth enriched with the floatable minerals. The agitation and aeration are also regulated to create a lower zone (41) containing a relatively dense or coarse component of the slurry (3), and an intermediate zone (42) containing a substantially less dense or finer component of the slurry (3). The surface froth is progressively withdrawn via a launder (30) thereby to produce a flotation concentrate. Similarly, the relatively dense component of the slurry (3) is progressively withdrawn from the lower zone (41) via a bottom inlet (26), and the relatively less dense of the slurry (3) is progressively withdrawn from the intermediate zone (42) via a side outlet (28).

7 Claims, 4 Drawing Sheets

FLOTATION METHOD AND APPARATUS FOR TREATMENT OF CYCLONE SANDS

The present invention relates to flotation processes and devices of the type used in mineral separation, and more particularly to flotation in connection with a grinding mill.

In the mineral separation field, the secondary comminution of mineral ores usually takes place in so-called "grinding circuits" which comprise one or more grinding mills operating together with a classifier. The classifier separates the mill discharge into a relatively fine component which is fed downstream for further processing, and a relatively coarse component which is returned to the mill for further grinding.

The most common form of classifier is a centrifugal cyclone separator. However, whilst this is reasonably effective on a small scale, in the case of large cyclones, the size-separation characteristic (or so-called "Tromp Curve") typically is flat, so that the sharp transition required for accurate and efficient separation is not achieved. The efficiency of the classifier dictates to a large degree the efficiency of the grinding circuit as a whole and for this reason, several methods have been proposed in the past, in an attempt to improve the efficiency of the classification process.

One such method consists in the addition of water to the cyclone spigot area, in order to wash residual "fines" from the coarse product before it is recirculated to the grinder. Another method involves two-stage cycloning, which makes use of two consecutive cyclones connected in series, or a single cyclone unit having two internal cyclone stages. However, neither of these processes has become widely accepted because of several inherent limitations. Firstly, it has been found in practise that using the same centrifugal force parameters twice for the same slurry provides at best a marginal increase in separation efficiency. Furthermore, the dual classification stages consume greater pumping energy and more significantly, require the addition of dilution water between the cyclonic stages which is detrimental to the efficiency of the grinding circuit as well as subsequent concentrating processes such as flotation.

In an attempt to circumvent these problems, it has also been proposed to use "de-sliming cones" or "cone classifiers" for the separation of slimes and fines from cyclone sands. The problem with this, however, is that because the classification process in fact discriminates according to particle weight rather than particle size, the relatively heavy minerals are over-represented in the underflow product which is recirculated to the grinding mill. Consequently, this valuable mineral component is ground too finely for effective recovery. Furthermore, such units only operate effectively under laminar conditions, and again require relatively large amounts of dilution water which is undesirable in terms of the other processes. Furthermore, the unit capacity remains low. These limitations have prevented the widespread adoption of such methods.

Vibrating screens have also been used as a second classification stage. However, it has been found that such screens are subject to rapid abrasive wear and in any event provide relatively low capacity per unit area. This has led to relatively large screens being required, which increases the capital cost and leads to further difficulties in ensuring even feed distribution on the screen surface.

Flotation has also been used in an attempt to compensate for the relatively low efficiency of conventional classifiers. In the early years of mineral processing, so-called "unit cells" were used to separate floatable minerals from the mill discharge in order to prevent excessive grinding of these minerals. However, poor flotation kinetics, and associated high reagent costs together with difficulties in handling the coarse mineral components in these low capacity cells have practically eliminated this type of process.

This has led, however, to the adoption of so-called flash flotation as a means of successfully separating floatable minerals from coarse cyclone underflow slurry. Flash flotation cells typically comprise a tank to receive and contain sludge from the grinding circuit and an agitator disposed within the tank to agitate the sludge. An aeration system is also provided to direct air under pressure into the agitator through a central circuit extending through a central drive shaft. As the bubbles from the aeration system rise towards the surface of the tank, they carry with them floatable mineral particles which become entrained in the surface froth. The mineral enriched froth then migrates over a lip into a peripheral launder for removal from the cell as mineral concentrate. Coarser and denser particles fall from suspension as they enter the cell, for removal through a discharge outlet formed in the bottom of the tank. In order for this process to operate efficiently, however, dilution water must normally be added to the feed of flotation cell. Most of this water goes to the underflow product or "tailings" of the cell and on recirculation decreases the effectiveness of the grinding circuit. The operator then needs to compromise between the grinding capacity of the mill and the efficiency of the flash flotation process. In such circumstances, however, because of these competing considerations involving the addition of dilution water, neither process can be fully optimised.

It is an object of the present invention to overcome or substantially ameliorate at least some of these disadvantages of the prior art.

Accordingly, in a first aspect, the invention provides a method for extracting floatable minerals from a slurry, said method comprising the steps of:

a flash flotation device comprising a tank to contain slurry incorporating floatable minerals to be extracted, a feed inlet for admission of the slurry into the tank, agitation means to agitate the slurry within the tank, aeration means to aerate the slurry, and control means to regulate the agitation and aeration so as to create an upper zone containing froth enriched with the floatable minerals, a lower zone containing a relatively dense or coarse component of the slurry, and an intermediate zone containing a substantially less dense or finer component of the slurry, the device further including a top outlet for progressive removal of the surface froth from the upper zone via launder to provide flotation concentrate, a bottom outlet for progressive withdrawal of the relatively dense component of the slurry from the lower zone, and a side outlet for progressive removal of the relatively less dense component of the slurry from the intermediate zone in the tank.

According to a second aspect, the invention provides a flash flotation device wherein the side outlet includes a first control valve and the bottom outlet includes a second control valve.

Preferably, the side outlet includes a first control valve and the bottom outlet includes a second control valve. The first and second control valves are preferably in the form of pinch valves, each regulated via a PID controller in response to an output signal from a liquid level sensor, to maintain the liquid in the tank at the predetermined level. It will be appreciated, however, that any suitable form of valve may be used. In one alternative embodiment, the first control valve in the side outlet takes the form of an overflow weir, the effective height of which may be adjustable to regulate the liquid level in the tank.

The apparatus preferably further includes dilution means for the addition of dilute water into the slurry, for example via the feed inlet or by some other means.

The slurry preferably takes the form of the discharge from a grinding mill, following initial classification and separation via a centrifugal cyclone separator. It is also possible, however, to use this method without a preceding cyclone classification step in which case the mill discharge is fed directly to the flash flotation cell. The valuable minerals are then recovered in form of a concentrate at the top of the cell, whilst the fine tailings from a feed to conventional flotation tanks and the coarse tailings including the non-floatable coarse minerals are returned to the process mill for further grinding.

BRIEF DESCRIPTION OF THE DRAWINGS

A preferred embodiment of the invention will now be described, by way of example only, with reference to the accompanying drawings in which.

Figure 1:
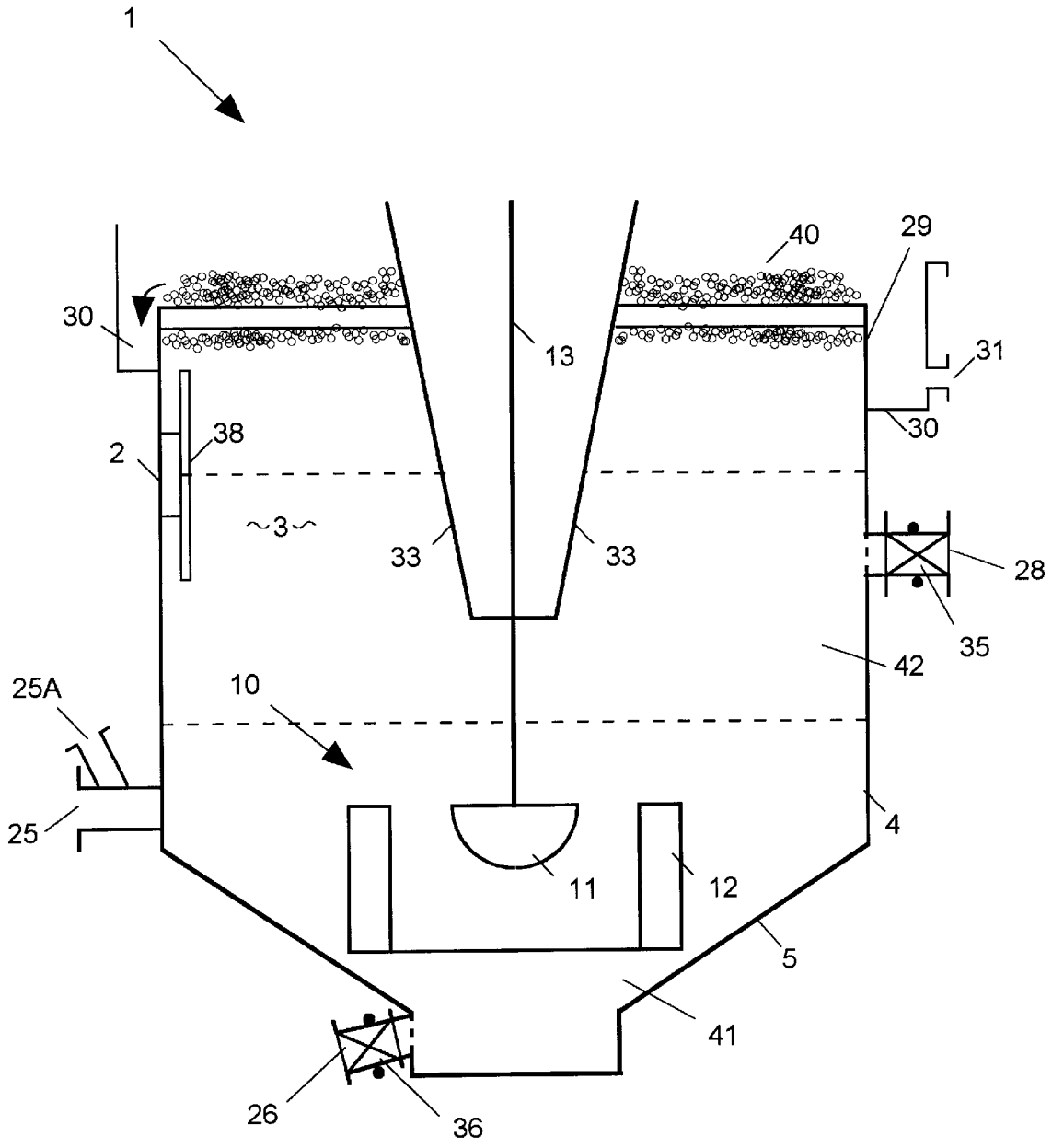
FIG. 1 is a diagrammatic cross-sectional side elevation showing a flash flotation cell according to the invention.

Referring firstly to FIG. 1, the invention provides a flash flotation cell 1 comprising a tank 2 to contain a slurry 3 incorporating minerals to be extracted. The slurry preferably comprises a relatively high density pulp, fed from the underflow of a cyclone separator, downstream of a grinding mill. The tank is defined by generally cylindrical side walls 4, a conical bottom section 5, and an open top. An agitation mechanism 10 is disposed to agitate the slurry within the tank. The agitator comprises a rotor 11 supported for rotation within a surrounding stator 12. The rotor is driven via a central drive shaft 13 extending downwardly into the tank. The flotation cell further includes an aeration system comprising an air compressor and a fluid conduit (not shown) to direct air from the compressor into the agitator. The conduit is defined in part by an axial bore extending through the drive shaft 13 of the rotor.

The feed slurry is introduced via a feed inlet 25 formed in the side wall of the tank. If and when required, dilution water may be simultaneously introduced via associated water inlet 25A or alternatively by other means. A bottom outlet 26 is formed in the lower conical section 5 of the tank. A side outlet 28 is similarly formed in the side wall of the tank. The top of the tank is defined by a froth overflow lip 29 which drains into a surrounding overflow launder 30. The overflow launder in turn drains into a froth outlet 31. A conical baffle 33 directs upwardly migrating froth progressively outwardly toward the overflow froth lip 29.

Flow through the side outlet is regulated by a first control valve 35, preferably in the form of a pinch valve. Flow through the bottom outlet is regulated by a second control valve 36, which in the preferred embodiment is also a pinch valve although it will be appreciated that any suitable form of valve may be used in either case. The first control valve 35 is regulated automatically via a proportional integral differential (PID) controller, in response to an output signal from a liquid level sensor 38 so as to control throughput and maintain the liquid in the tank at a preset level. The bottom valve 36 may also be regulated via the PID controller if required. In an alternative embodiment, the side outlet and associated control valve may simply be defined by a weir plate, the effective height of which may optionally be adjustable so as to define the preset level in the tank.

Turning now to describe the operation of the cell in more detail, the slurry from the cyclone underflow is initially fed into the tank via feed inlet 25 and dilution water progressively added through inlet 25A as and when required. From there, the dilute feed slurry migrates generally toward the agitation and aeration assemblies positioned near the bottom of the tank. The combined agitation and aeration creates bubbles and froth which migrate progressively upwardly towards the surface collecting the floatable mineral particles suspended in the slurry. Near the surface, the mineralised froth migrates progressively outwardly along conical baffle 33, to form an upper zone 40 of froth which flows over the froth lip 29 and into the peripheral overflow launder 30. From there, the mineral enriched overflow is recovered as flotation concentrate through the top outlet 31.

At the same time, the relatively coarse and dense components of the slurry settle into the bottom conical section 5 to form a lower zone 41. These coarse components are progressively removed through the bottom outlet 26 via the associated second control valve 36. The side outlet 28 simultaneously permits the outflow of intermediate components of the slurry, through the first control valve 35, which is responsive to a feedback loop from the liquid level sensor in the tank via the PID controller. In this way, the first control valve 35 in the side outlet maintains a dynamic equilibrium between the various inflows and outflows and maintains the liquid in the tank at a predetermined level.

It has been found that with appropriate regulation of the agitation and aeration systems, a well defined intermediate zone 42 can be established and maintained in dynamic equilibrium, wherein the slurry is relatively fine and low density, usually between 15% and around 25% of solids by weight. In this zone, the coarsest mineral particles are approximately 0.3 mm in diameter and the content of valuable minerals is surprisingly low. By contrast, the pulp density in the lower zone is significantly higher, typically up to around 75% by weight solids, with the material enriched with coarse particles, even up to 10 to 20 mm in diameter.

Thus, by carefully controlling the degree of agitation and aeration within the tank, a relatively clear transition between this intermediate zone 42, the froth zone 40 above, and the dense pulp zone 41 below, can be maintained, whilst still ensuring effective flotation. This enables the fine tailings to be discharged at surprisingly low pulp density through the side outlet together with most, if not all, of the dilution water. This component can then be returned via the mill discharge hopper to the sump of the cyclone pump, in which case the fine tailings can act as dilution liquid for the classifier and complete the water balance within the grinding circuit. Alternatively, because of the relatively close size distribution, it can be discharged directly into the main flotation circuit or to a separate cleaning circuit, as the case may be. The main benefit here is that extra water can be used to reduce the pulp density in the flash flotation cell and then recovered via the side outlet and used as dilution water for the cyclone, thus ensuring a water balance within the grinding circuit.

Figure 2:
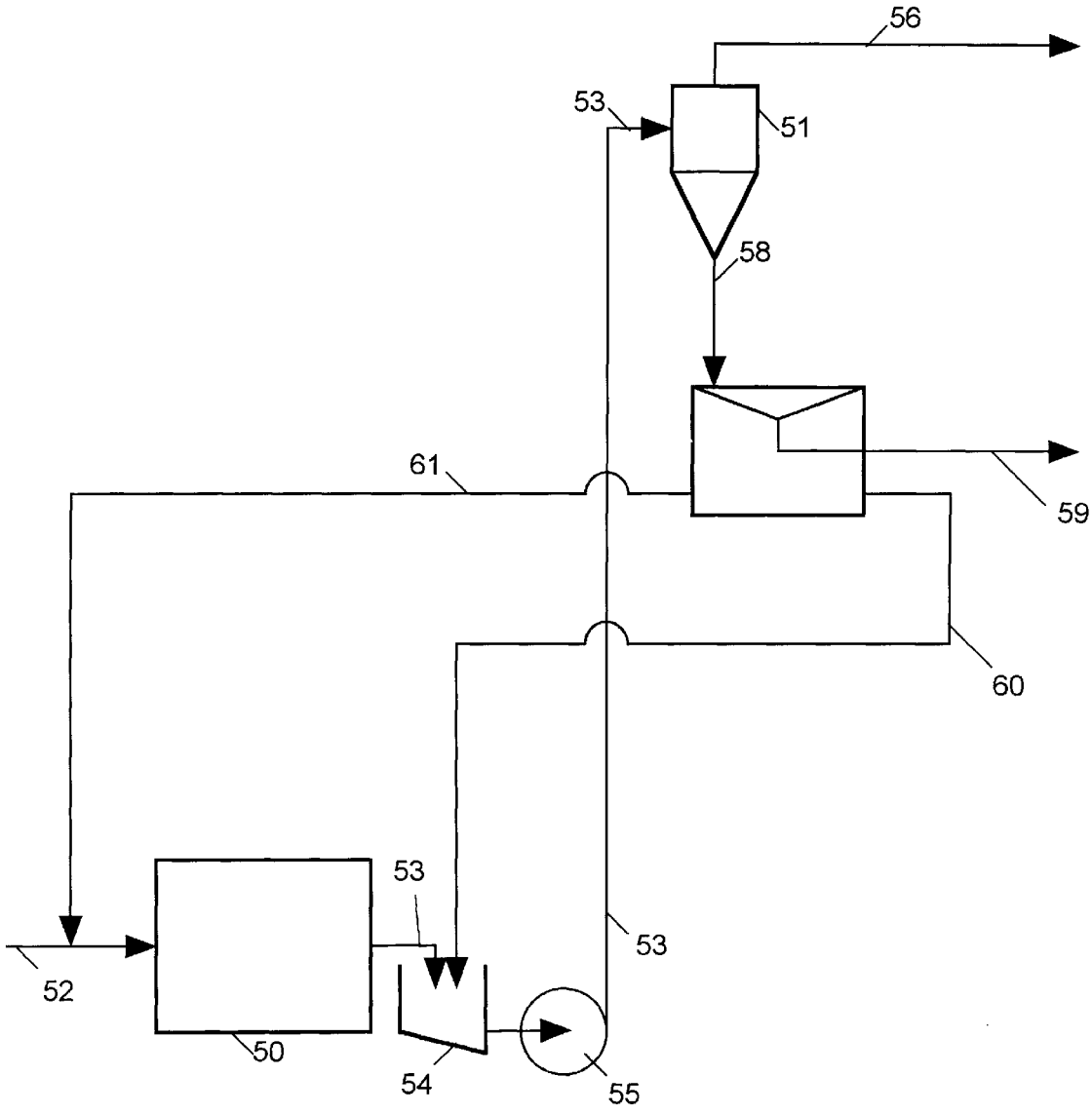
FIG. 2 is a schematic flow diagram showing the flash flotation cell of FIG. 1 connected to a grinding circuit including a mill and a centrifugal cyclone classifier according to the invention.

FIG. 2 is a schematic flow chart showing the flotation cell of FIG. 1 operating in conjunction with a grinding circuit comprising a grinding mill 50 and a centrifugal classifier in the form of cyclone 51. In this case, new feed material 52 enters the mill for grinding. The mill discharge 53 is fed into a pump hopper 54. From there, the pump 55 transfers the ground feed 53 to the cyclone 51. The fine product 56 from the classifier is discharged through the cyclone overflow for concentration downstream, for example in a thickener. The coarse product 58 passes from the cyclone underflow to the flash flotation cell 1.

In the flash flotation cell, the concentrate product 59 is separated by flotation and discharged through the upper outlet 31 in the manner previously described. A fine product 60 is discharged through the intermediate outlet 28 via the first control valve 35 and thence returned to the pump hopper 54. The coarse product 61 from the flotation cell is discharged through the bottom outlet 26 via the second control valve 36 and returned to the mill for regrinding together with the new feed 52.

Figure 3:
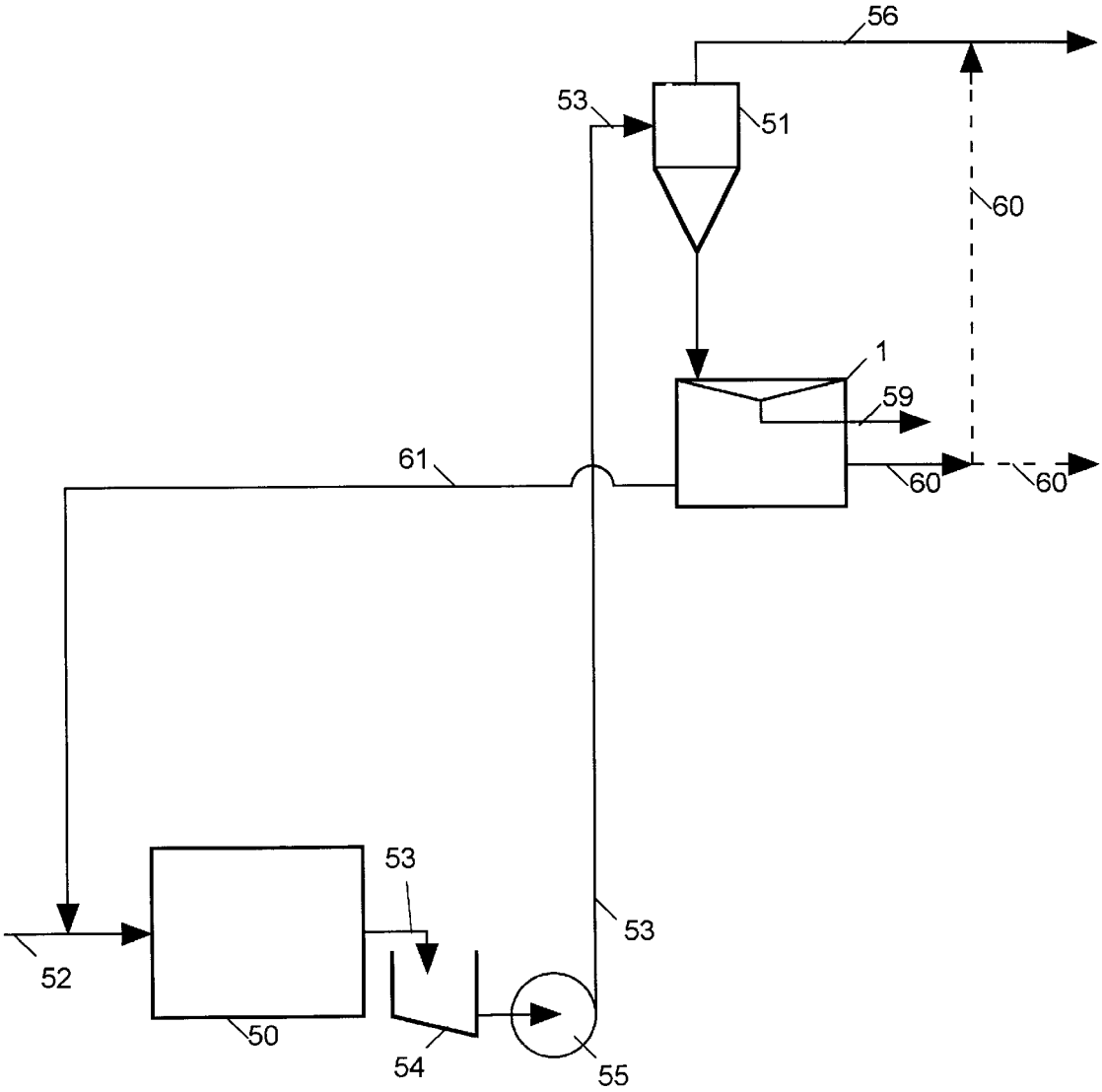
FIG. 3 is a schematic flow diagram showing the flash flotation cell of FIG. 1 connected to the grinding circuit according to a second configuration.

FIG. 3 shows a similar arrangement to that illustrated in FIG. 2, except that in this case, the fine product 60 from the flash flotation cell is not recirculated to the pump hopper 54 but discharged downstream for further processing, for example, in main flotation tanks or thickeners, either combined with the overflow product 56 from the classifier or on its own.

Figure 4:
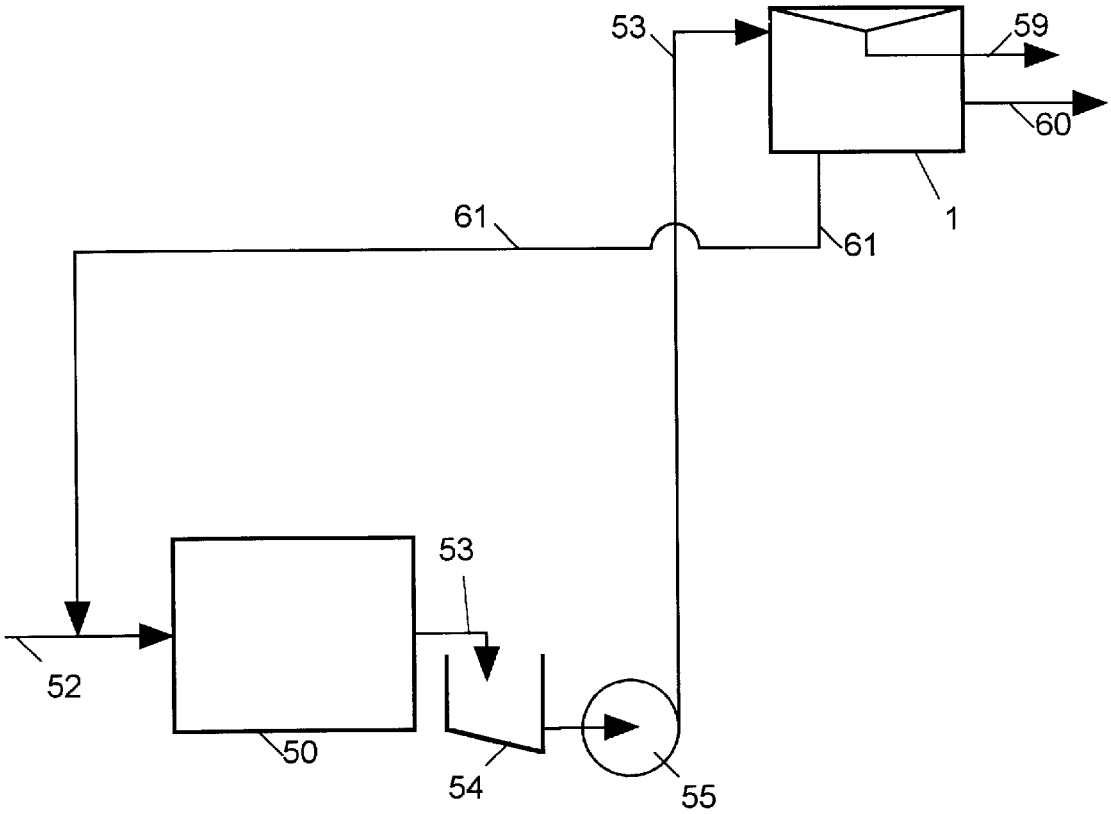
FIG. 4 is a schematic flow diagram showing the flash flotation cell of FIG. 1 connected directly to a grinding mill according to a third configuration.

FIG. 4 shows a further variation where the centrifugal classifier 51 has been eliminated altogether from the grinding circuit. In this case, the classifying capabilities of the flash flotation cell according to the present invention are used in such a way that the fine product 60 represents the total process flow, except for the concentrate product 59 separated by flotation, and is simply discharged for further processing downstream. The coarse product 61 is returned to the mill for regrinding, as in the previous examples. The benefit of this system as compared with the previous arrangements is that the valuable heavy floatable minerals are prevented from returning to the grinding mill, which can otherwise occur via the underflow of cyclone classifiers because of the high specific gravity of these minerals. In contrast, the underflow from the flotation cell is devoid of this floatable mineral component.

In each case, it will be appreciated that because the fine tailings product removed through the side outlet of the flotation cell contains most of the dilution water, and because it need not be recirculated through the grinding mill, the mill operator may freely select the optimum dilution ratio for the flotation process, without adversely affecting the pulp density in grinding unit and vice versa. Thus, the conditions for both the grinding and classification stages, as well as for the subsequent flash flotation stage, can be freely selected and optimised for any process parameters whilst maintaining the overall water balance in the system. Furthermore, the separation "split" on the cyclone is sharpened. Accordingly, in many respects the invention represents a commercially significant improvement over the prior art.

Although the invention has been described with reference to specific examples, it will be appreciated by those skilled in the art that the invention may be embodied in many other forms.

We claim:

1. A flotation device for extracting floatable minerals from a slurry, the flotation device including:

a tank having a feed inlet for admitting the slurry to the tank, a top outlet for progressive removal of material from an upper zone of the tank, a bottom outlet for progressive removal of material from a lower zone of the tank, and a side outlet for progressive removal of material from an intermediate zone of the tank, a first control valve for controlling removal of material from the side outlet, a second control valve for controlling removal of slurry from the bottom outlet, an agitation means to agitate the slurry in the tank, and an aeration means to aerate the slurry, wherein agitation and aeration of the slurry create a froth over a free surface of the slurry, and the flotation device further includes:

a level sensor for detecting level of the free surface of the slurry in the tank, and a control means to control the first control valve in response to the level sensor so as to maintain the free surface of the slurry in the tank at a substantially constant level, whereby the surface froth is removed from the tank by way of the top outlet, a relatively more dense component of the slurry is removed from the tank by way of the bottom outlet, and a relatively less dense component of the slurry is removed from the tank by way of the side outlet.

2. A flotation device according to claim 1, wherein the control means controls the second valve.

3. A flotation device according to claim 1, wherein the first and second control valves are pinch valves.

4. A flotation device according to claim 1, further including dilution means for adding water to the slurry.

5. A flotation device according to claim 4, wherein the dilution means includes a feed water duct for adding water to the slurry via the feed inlet.

6. Apparatus for processing a mineral ore, comprising:

a grinding mill for grinding the ore and providing a slurry, and a flotation device for extracting floatable minerals from the slurry, the flotation device including:

a tank having a feed inlet for admitting the slurry to the tank, a top outlet for progressive removal of material from an upper zone of the tank, a bottom outlet for progressive removal of material from a lower zone of the tank, and a side outlet for progressive removal of material from an intermediate zone of the tank, a first control valve for controlling removal of material from the side outlet, a second control valve for controlling removal of slurry from the bottom outlet, an agitation means to agitate the slurry in the tank, and an aeration means to aerate the slurry, wherein agitation and aeration of the slurry create a froth over a free surface of the slurry, and the flotation device further includes:

a level sensor for detecting level of the free surface of the slurry in the tank, and a control means to control the first control valve in response to the level sensor so as to maintain the free surface of the slurry in the tank at a constant level, whereby the surface froth is removed from the tank by way of the top outlet, a relatively more dense component of the slurry is removed from the tank by way of the bottom outlet, and a relatively less dense component of the slurry is removed from the tank by way of the side outlet.

7. Apparatus according to claim 6, further comprising a centrifugal cyclone for receiving the slurry provided by the grinding mill and separating it into a fine fraction and a coarse fraction, and supplying the coarse fraction to the flotation device.

* * * * *